United States Patent [19]

Gross et al.

[11] Patent Number: 4,962,869

[45] Date of Patent: Oct. 16, 1990

[54] TOGGLE-ACTING DISPENSING CLOSURE WITH IMPACT RESISTANCE

[75] Inventors: Richard A. Gross; Bruce M. Mueller, both of Crystal Lake, Ill.

[73] Assignee: Sequist Closures, Crystal Lake, Ill.

[21] Appl. No.: 336,257

[22] Filed: Apr. 11, 1989

[51] Int. Cl.[5] ..... B67D 5/32; B65D 47/00

[52] U.S. Cl. ..... 222/153; 222/536; 222/556

[58] Field of Search ..... 222/153, 533, 536, 556

[56] References Cited

U.S. PATENT DOCUMENTS

| | | | |
|---|---|---|---|
| 3,223,287 | 12/1965 | Sagarin | 222/153 |
| 3,318,494 | 5/1967 | Porter et al. | 222/536 |
| 3,542,256 | 11/1970 | Waterman | 222/536 |
| 4,081,108 | 3/1978 | Wilson et al. | 222/536 |
| 4,095,725 | 6/1978 | Goncalves | 222/153 |
| 4,487,342 | 12/1984 | Shy | 222/536 |
| 4,645,086 | 2/1987 | Rosenthal | 222/536 |
| 4,776,501 | 10/1988 | Ostrowsky | 222/556 |

*Primary Examiner*—H. Grant Skaggs
*Assistant Examiner*—Steve Reiss
*Attorney, Agent, or Firm*—Dressler, Goldsmith, Shore, Sutker & Milnamow, Ltd.

[57] ABSTRACT

A toggle-acting dispensing closure which is resistant to inadvertent actuation during shipping and handling prior to purchase. A deformable resistance post is provided on the body of the closure and interferes initially with the pivoting of the actuator except when a substantially higher force than normally used to pivot the actuator is applied. After the first operation by applying the substantially higher force, the actuator may be operated by the application of a customary lower operating force to the actuator.

6 Claims, 1 Drawing Sheet

FIG. 1
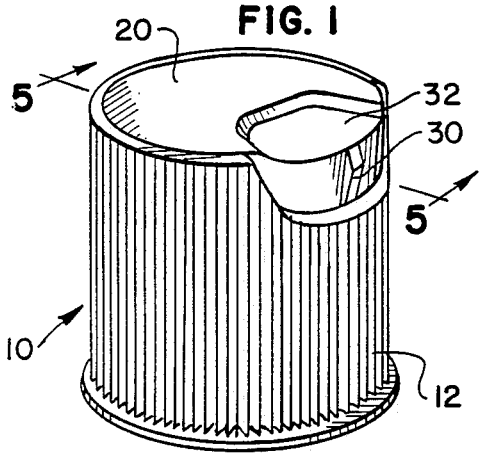
FIG. 3
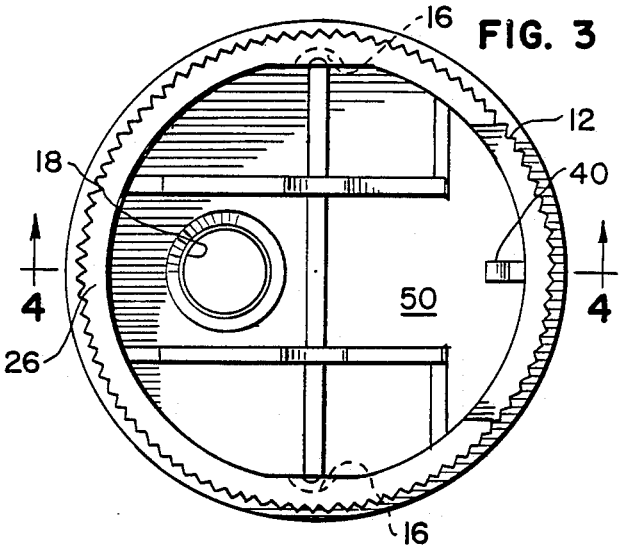
FIG. 2
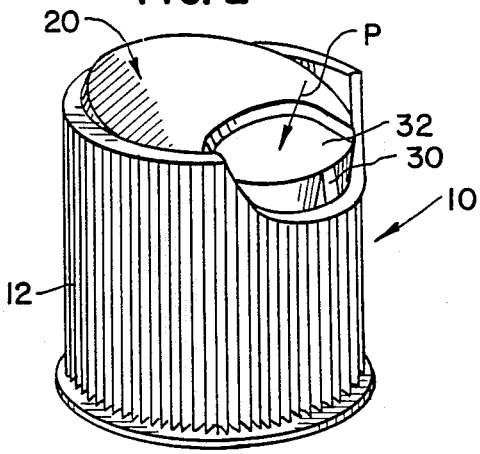
FIG. 4
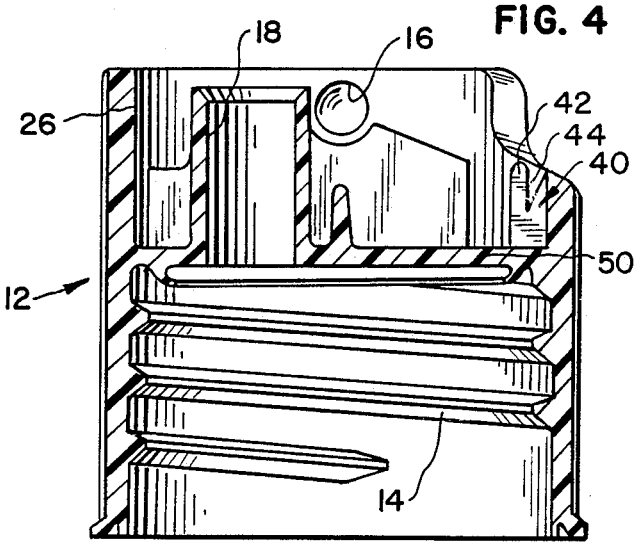
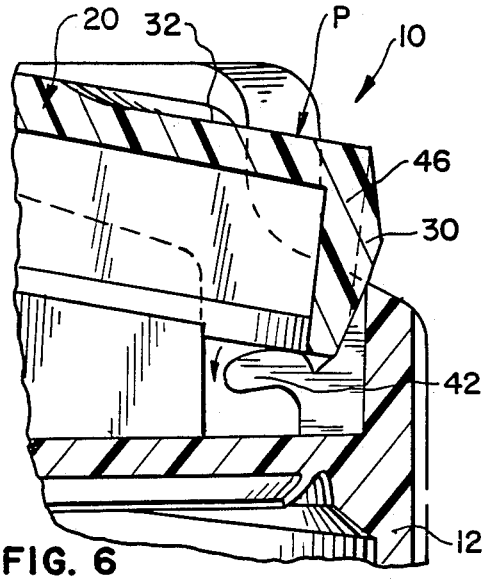
FIG. 6
FIG. 5
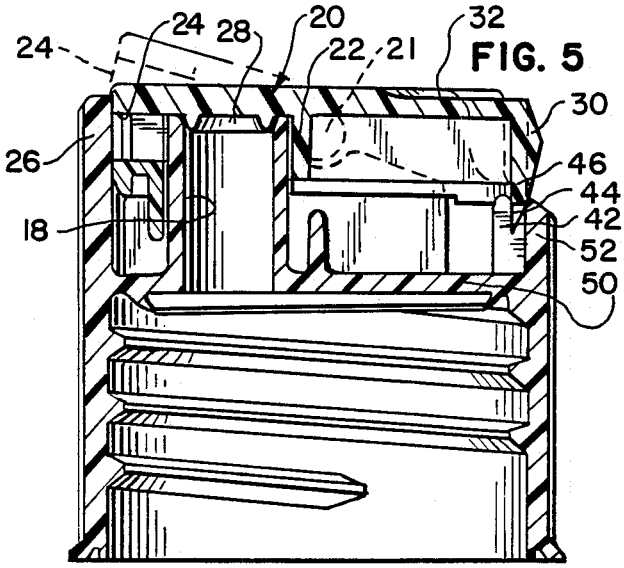

TOGGLE-ACTING DISPENSING CLOSURE WITH IMPACT RESISTANCE

BACKGROUND OF THE INVENTION

A variety of dispensing closures for containers for consumer use are currently available. One such closure which combines highly effective operation with desirable aesthetics is a toggle-acting closure in which the actuator is pivotally mounted for pivotal movement between a closed position and an open dispensing position.

One difficulty which is sometimes encountered with such closures is that in shipping and handling, the closure is inadvertently and accidentally moved to the open dispensing position, resulting in spillage of the contents and damage of the container as a saleable item.

It would therefore be of advantage to provide an improved toggle-acting closure in which the possibility of undesirable leakage would be substantially reduced, all without changing or affecting the operation or aesthetics of the closure and associated container, and without otherwise significantly changing the structure.

SUMMARY OF THE INVENTION

In accordance with the present invention, a toggle-acting dispensing closure is provided which is resistant to inadvertent actuation during shipping and handling prior to purchase. The closure desirably comprises a body, an actuator defining a discharge opening which is pivotably mounted on the body for pivotal movement of the actuator on the body normally in response to a first force applied to the actuator at a first position on the actuator for movement of the actuator between a closed, non-dispensing position and an open dispensing position, and a permanently deformable resistance means on the body and confronting an actuator portion, the resistance means preventing movement of the actuator in response to the application of a first force at a first location, but permitting movement of the actuator in response to a substantially higher second force at the first location, whereby when the second force is applied, the resistance means will be permanently deformed, and thereafter the actuator will move to the open position in response to the application of the first force at the first location.

Preferably the actuator defines trunnions pivotally received in recesses in the body, and the resistance means is positioned oppositely from the discharge opening. The resistance means may desirably underlie a portion of the actuator and may define a notch to receive a portion of the actuator. In the most preferred form the actuator portion shears the resistance means in the zone of the notch.

Further objects, features and advantages will become apparent from the following description and drawings.

BRIEF DESCRIPTION OF THE DRAWINGS

FIG. 1 is a perspective view of a closure of the present invention in a closed, non-dispensing position;

FIG. 2 is a perspective view, like FIG. 1, with the actuator in an open dispensing position;

FIG. 3 is a plan view of the closure of FIG. 1 with the actuator removed;

FIG. 4 is a sectional view taken substantially along line 4—4 of FIG. 3;

FIG. 5 is a view like FIG. 4, but taken along line 5—5 of FIG. 1; and FIG. 6 is a fragmentary enlarged view like FIG. 5, but with the actuator forced to the dispensing position.

DESCRIPTION OF A PREFERRED EMBODIMENT

Referring now to the drawings, a toggle-acting dispensing closure 10 of the present invention includes a body 12 defining threads 14 for threaded securance to the neck of a container (not shown). Body 14 may be integrally molded of plastic, such as of polypropylene, polyethylene, polyoxymethylene, polystyrene, polybutylene, polymethylpentene or styrene-acrylonitrile. An actuator 20 is pivotally mounted on the body 12 via trunnions 21 which are retained in recesses 16 defined by the body. As such, the actuator 20 is toggle-acting, i.e., is pivotally movable about the trunnions (and recesses 16) from the closed, non-dispensing position shown by FIGS. 1 and 5, to the open dispensing position shown by FIGS. 2 and 6. Actuator 20 may be integrally molded of plastic, such as of polypropylene, polyethylene, polyoxymethylene, polystyrene, polybutylene, polymethylpentene or styrene-acrylonitrile.

As seen in FIGS. 4 and 5, the body 12 defines a passageway comprising a discharge opening 18 which is in flow communication with the actuator 20. Actuator 20 defines a flow receiving sleeve 22 which, at its forward side, defines a dispensing passage 24. When the actuator 20 is in the non-dispensing position (FIG. 5), the passage 24 sealingly engages a front wall portion 26 of the body 12, preventing discharge through passage 24. Additionally, the discharge opening 18 in the body is sealed within the flow-receiving sleeve 22, as by a sealing post 28.

When the actuator is toggled or pivoted to the position of FIG. 6 (as seen in partial dotted line in FIG. 5 as well), the discharge passage 24 is positioned above the front wall portion 26 and liquid is free to flow from the container through discharge opening 18, receiving sleeve 22 and discharge passage 24.

To help stabilize the actuator 20 in an open position, the actuator may include a rearwardly positioned stabilizing projection 30 which bears against the confronting body portion, especially in the open position thereby to help maintain the actuator 20 in the open position. Stabilizing projection 30 also provides frictional resistance to pivoting of the actuator 20 by frictionally engaging and bearing against upstanding wall portion 52. This frictional resistance augments other resistance to pivotal movement of the actuator 20, thereby normally requiring a first force to move the actuator between the closed position and the open dispensing position.

As so far described, the closure 10 is identical to closures which have been made for some years by Seaquist Closures, a division of Pittway Corporation.

In accordance with the present invention a permanently deformable resistance means, such as a deformable resistance post 40 is provided to prevent accidental movement of the actuator 20 to the open, dispensing position, thereby to provide a closure 10 which is resistant to inadvertent actuation during shipping and handling prior to purchase by a consumer.

As best seen in FIGS. 2–6, resistance post 40 is positioned at the rear of the closure 10 on the side of the center line defined by trunnions 21 and recesses 16 which is opposite from the discharge passage 24. Thus, when the customary actuation force is applied to a finger pad portion 32 of the actuator 20, the resistance post will prevent toggling. Therefore, to expose the discharge passage 24 for dispensing, a much higher than usual force must be applied. Because of that, accidental opening of the closure and accidental leakage from the container is eliminated, and the typical causes of such opening in handling and shipping fail to cause opening.

As is apparent, the actuator is normally pivotally movable on the body in response to a first force applied to the actuator at a first location P (FIG. 6) on the finger pad portion. However, the resistance post 40 requires the application of a second substantially higher force at the first location to move the actuator to the open dispensing position. Preferably the second force is substantially greater than the first force, such as at least about one and one-half times the first force.

As shown the resistance post 40 is integrally molded with the closure body at the juncture of a body floor portion 50 and the rear upstanding wall portion 52. Preferably post 40 is positioned to extend along the body diameter which includes a center-line of the discharge opening 18 and the discharge passage 24. Post 40 defines a forward leg 42, rearwardly of which is provided a notch 44. Notch 44 is positioned to underlie and receive the bottom edge of a depending portion, such as the parametric sleeve 46 of the actuator 20. It will be appreciated that when the higher second force is applied to the finger pad portion 32 of actuator 20, the actuator will be forced to pivot and the depending sleeve 46 will descend in the zone of the notch 44 and will shear or cut the post 40, either shearing the forward leg off altogether, depending upon the material of the body and the construction of the post 40, or will force the leg 42 forwardly as illustrated in FIG. 6 into a permanently deformed condition. Thereafter, the post 40 will not interfere with the operation of the closure 10, and the closure 10 will behave just as current closures without the resistance post 40 operate.

Exemplary of the forces applied are a customary or normal first force of from about 1 to 5 or even up to 7 or 8 pounds, and a second substantially higher force of at least about one and one-half the first force. For example, a first force of about seven pounds and a second force of about ten pounds, a ratio of about one and one-half would be quite satisfactory.

Thus, except for the first use, the closure 10 need be no different from current closures. The outside appearance need not be changed. The inconvenience to the consumer is minimal and no special instructions need be given. Existing tooling can be easily and inexpensively modified. And, of course, loss of contents and leakage and destruction of packages are eliminated; resistance to accidental impact is substantially increased.

It will be apparent to those skilled in the art that the principles of this invention may be applied to a wide range of toggle-acting dispensing closures and that a variety of resistance post constructions may be developed for use depending upon the specific construction of the toggle-acting dispensing closure to which the principles are applied. As such, the invention is to be construed in that light, and is not intended to be limited to the specific embodiment illustrated.

What is claimed is:

1. A toggle-acting dispensing closure which is resistant to inadvertent actuation during shipping and handling prior to purchase comprising:

a body having a planar floor portion;

an actuator overlying the floor portion, defining a discharge opening and being pivotably mounted on said body for pivotal movement of the actuator on the body normally in response to a first force downwardly applied to said actuator at a first location on said actuator for movement of the actuator between a closed, non-dispensing position and an open dispensing position; and deformable resistance post means opposite the discharge opening on said body and confronting a depending peripheral actuator portion, said resistance post means engaging said depending peripheral actuator portion and preventing movement of said actuator in response to the application of said first force at said first location, but permitting movement of said actuator in response to a substantially higher second force downwardly applied at said first location;

whereby when said second force is applied at said first location, said resistance post means will be permanently deformed by said depending peripheral actuator portion, and thereafter said actuator will move to said open dispensing position in response to the application of said first force.

2. A toggle-acting dispensing closure in accordance with claim 1 and wherein said actuator defines trunnions pivotally received in recesses in said body, and said resistance means is positioned oppositely from said discharge opening.

3. A toggle-acting dispensing closure in accordance with claim 1 and wherein said resistance post means defines a notch to receive a depending peripheral portion of said actuator.

4. A toggle-acting dispensing closure which is resistant to inadvertent actuation during shipping and handling prior to purchase comprising:

a body;

an actuator having a depending portion and defining a discharge opening and being pivotably mounted on said body for pivotal movement of the actuator on the body normally in response to a first force applied to said actuator at a first location on said actuator for movement of the actuator between a closed, non-dispensing position and an open dispensing position, said actuator defining trunnions pivotally received in recesses in said body; and upstanding deformable resistance means on said body and confronting said depending actuator portion, said resistance means defining a notch to receive said depending portion of said actuator, said upstanding resistance means being positioned oppositely from said discharge opening, said resistance means preventing movement of said depending actuator portion downwardly in said notch in response to the application of said first force at said first location, but permitting movement of said actuator downwardly in said notch in response to a substantially higher second force at said first location;

whereby when said second force is applied at said first location, said upstanding resistance means will be permanently deformed, and thereafter said actuator will move to said open dispensing position in response to the application of said first force.

5. A toggle-acting dispensing closure in accordance with claim 4, and wherein said depending actuator portion shears said resistance means in the zone of said notch when said second force is applied at said first location.

6. A toggle-acting dispensing closure in accordance with claim 5, and wherein said resistance means permits movement of said actuator only in response to a force which is about one and one-half times the first force.

* * * * *

UNITED STATES PATENT AND TRADEMARK OFFICE

CERTIFICATE OF CORRECTION

PATENT NO. : 4,962,869

DATED : October 16, 1990

INVENTOR(S) : Richard A. Gross and Bruce M. Mueller

It is certified that error appears in the above—identified patent and that said Letters Patent is hereby corrected as shown below:

ON TITLE PAGE:

In the Assignee, change the spelling of "Sequist" to --Seaquist--.

Signed and Sealed this

Twenty-first Day of July, 1992

*Attest:*

DOUGLAS B. COMER

*Attesting Officer*

*Acting Commissioner of Patents and Trademarks*